US005513453A

United States Patent [19]

Norton

[11] Patent Number: 5,513,453

[45] Date of Patent: May 7, 1996

[54] REVERSING SNOW PLOW

[75] Inventor: Dan J. Norton, Brighton, Mich.

[73] Assignee: Athlone Equipment Sales Corp., Brighton, Mich.

[21] Appl. No.: 259,519

[22] Filed: Jun. 14, 1994

[51] Int. Cl.[6] ..... E02F 3/76; D06F 71/00

[52] U.S. Cl. ..... 37/244; 37/253; 172/815

[58] Field of Search ..... 37/231, 232, 234, 37/238, 240, 242, 244, 247, 253, 254, 266, 274, 299; 172/815, 816, 818, 820, 825, 834

[56] References Cited

U.S. PATENT DOCUMENTS

| | | | |
|---|---|---|---|
| 615,688 | 12/1898 | Duff . | |
| 1,419,263 | 6/1922 | Johnson | 37/253 |
| 1,466,187 | 8/1923 | Puth | 37/253 |
| 1,816,589 | 7/1931 | Johnson . | |
| 2,115,790 | 5/1938 | Sleeper et al. . | |
| 2,199,723 | 5/1940 | Garland et al. | 37/253 X |
| 2,241,252 | 5/1941 | Garland et al. | 37/244 X |
| 2,296,518 | 9/1942 | Greer et al. | 37/253 X |
| 2,369,293 | 2/1945 | Gotzlinger . | |
| 4,099,578 | 7/1978 | Stevens | 172/815 |
| 4,249,323 | 2/1981 | Mathis et al. | 172/815 |
| 4,307,525 | 12/1981 | Maloblocki | 37/317 X |
| 4,391,052 | 7/1983 | Guy, Jr. . | |
| 4,962,598 | 10/1990 | Wollhiser et al. . | |
| 5,048,579 | 9/1991 | Hoyd | 37/302 X |

OTHER PUBLICATIONS

*Walter Snow Thrower,* Walter Motor Truck Company.

*Primary Examiner*—Terry Lee Melius
*Assistant Examiner*—Robert Pezzuto
*Attorney, Agent, or Firm*—Reinhart, Boerner, Van Deuren, Norris & Rieselbach

[57] ABSTRACT

A combined snow plowing and snow throwing vehicle includes an elongate plow blade at its forward end. The plow blade can be shifted to direct snow to either of the right or the left and includes separate snow throwing fans mounted, respectively, at the right and left ends of the plow blade. A user-actuable control system provides independent actuation of the snow throwing structures so that the snow throwing structure at the downstream end of the plow blade is actuated regardless of whether the plow is directing snow to the right or to the left. This enables the vehicle to plow and throw snow to either the right or to the left and further enables the vehicle to clear snow while traveling both up and down an airport runway.

9 Claims, 2 Drawing Sheets

REVERSING SNOW PLOW

BACKGROUND OF THE INVENTION

This invention relates generally to snow removing equipment and, more particularly, to vehicle-mounted snow plows and throwers used in airport snow removal.

Snow removal is a constant concern during winter months in northern states. Airports in such areas frequently need to remove large quantities of snow quickly and efficiently from active runways, taxiways, and ramp areas. Given the increased traffic at many airports and the pressing public demand for on-time airline service, the need for efficient snow removal at airports is very real.

Airport snow removal is typically accomplished through use of both plows and snow throwers. Typically, one or more plows move down the runway plowing snow to the side. A snow thrower follows the plows and disperses the windrows that are left behind the plows. Although effective, this approach requires that the airport operating authority purchase, operate and maintain at least two separate, expensive pieces of equipment.

Various attempts have been made in the past to combine snow throwers and plows in a single device. In one device, a snow-throwing fan was located at one end of a plow. Snow accumulated by the plow was directed to the fan where it was propelled beyond the end of the plow. Although effective in removing snow, this device could only plow snow toward the end of the plow blade where the fan this device could only plow snow toward the end of the plow blade where the fan was located. Accordingly, a runway could be plowed in one direction only, requiring the device to "deadhead" back up the runway before each plowing pass. Given the length and width of many runways, considerable time could be wasted as the device "deadheaded" up the runway, removing no snow in the process.

In other devices, such as those shown in U.S. Pat. Nos. 2,296,518, 2,241,252, 2,199,723 and 2,115,790, rotary blades were incorporated at the outer ends of individual plow blades mounted on opposite sides of a truck. Although either plow could be used to clear snow, such systems were complicated and expensive, requiring sophisticated mechanical linkages to power the blades.

SUMMARY OF THE INVENTION

The invention provides a snow removal vehicle including an automotive frame having a forward end. An elongate plow blade is mounted at the forward end of the frame for selective movement between fight-directing and left-directing plowing positions. A pair of independently actuable snow-throwing structures are provided at opposite ends of the plow blade. A control system is provided for selectively actuating either one of the snow throwing structures so that a downstream one of the snow throwing structures can be actuated regardless of whether the plow is in the right-directing or left-directing position. This enables the snow removal vehicle to plow and throw snow to the right or to the left as desired.

The invention also provides a reversible combined snow plow and snow thrower. The reversible combined snow plow and snow thrower includes an elongate plow blade having fight and left ends. A movable mount is provided adjacent the center of the plow blade for mounting the plow blade to a supporting structure for pivoting movement to the right and left relative to the supporting structure. A first snow-throwing structure is disposed adjacent the fight end of the plow blade and second snow-throwing structure is disposed adjacent the left end of the plow blade. A control system is provided for actuating either one of the first and second snow-throwing structures so that the first snow-throwing structure is actuated when the plow blade is directed to the fight and the second snow-throwing structure is actuated when the plow blade is directed to the left.

It is an object of the present invention to provide a new and improved apparatus for removing snow from airports runways and the like.

It is a further object of the present invention to provide a new and improved snow removing apparatus that avoids excessive snow buildup along the sides of a plowed runway.

It is a further object of the invention to provide an improved snow removing apparatus that can direct snow to a particular side of an airport runway while the apparatus travels in either direction along the runway.

BRIEF DESCRIPTION OF THE DRAWINGS

The features of the present invention that are believed to be novel are set forth with particularity in the appended claims. The invention, together with the further objects and advantages thereof; may best be understood by reference to the following description taken in conjunction with the accompanying drawings, wherein like reference numerals identify like elements, and wherein:

DESCRIPTION OF THE PREFERRED EMBODIMENT

Figure 1:
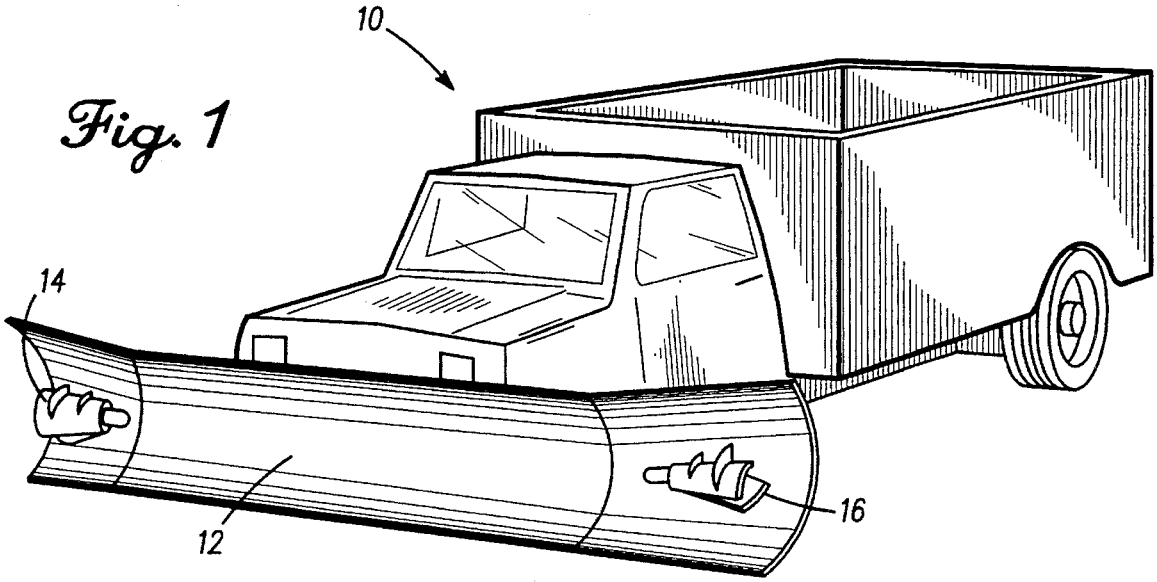
FIG. 1 is a perspective view of a snow removal vehicle equipped with a reversing snow plow in accordance with one aspect of the invention.

Referring to the drawings, a snow removal vehicle 10 embodying various aspects of the invention is shown. The snow removal vehicle 10, which in the illustrated embodiment is adapted for use in removing snow from airport runways and the like, generally comprises an automotive frame in the form of a four wheel drive track. It will be appreciated that automotive frames of other types, such as tread driven vehicles, can be used.

An elongate plow blade 12 is mounted at the forward end of the vehicle 10. In accordance with one aspect of the invention, the plow blade 12 is mounted for selective movement between fight-directing and left-directing plowing positions. In other words, the plow 12 can be selectively positioned to direct snow to either the fight or to the left as the vehicle 10 moves forward. The plow blade 12 comprises an elongate, arcuate plate formed of steel or similar rigid, durable material. The plow blade 12 is oriented horizontally and can be lowered to bring its lower edge into contact with the ground.

In accordance with one aspect of the invention, a pair of independently actuable snow throwing structures 14, 16 are provided at opposite ends of the plow blade 12. In the illustrated embodiment, each snow throwing structure 14, 16 comprises a propeller or fan that spins and thereby propels snow well beyond the end of the plow blade. The ends of the plow blade can be flared as illustrated to enhance the operation of the snow throwing structures, and movable deflector plates can be incorporated at the opposite ends of the plow blade 12 to control the direction the snow is thrown when the snow throwing structures 14, 16 are actuated.

When the snow removal vehicle 10 is in use, the blade 12 is lowered into contact with the ground and is angled to direct snow to either the fight or to the left. The downstream one of the snow throwing structures 14, 16 is actuated. Snow collected by the plow blade 12 as the vehicle 10 moves forward slides toward the downstream end of the blade 12 whereupon it encounters the actuated snow throwing structure 14, 16. The accumulated snow is then propelled by the actuated snow throwing structure 14, 16 well beyond the downstream end of the plow blade 12. The snow throwing structure 14, 16 at the opposite (upstream) end of the plow blade preferably remains idle during this time. When the vehicle 10 reaches the end of the runway or taxiway being plowed, it turns around and the direction of the blade 12 is reversed. The previously operating snow throwing mechanism 14, 16 is shut down and the formerly idle snow throwing mechanism 14, 16 located at what is now the downstream end of the plow 12, is actuated. In this manner, snow is continually directed to the same side of the runway regardless of which direction the plowing vehicle 10 is moving along the runway. Thus, snow clearing operations can continue as the vehicle 10 moves both up and down the runway. There is no need to "deadhead" back to the starting point at the end of each pass.

Preferably, the snow throwing mechanisms at the ends of the plow blade 12 are powered by independently actuable hydrostatic motors 18, 20. Hydrostatic power for driving the motors can be derived from the primary engine of the vehicle 10 or from a separate, dedicated pump engine. Independent controls are preferably provided to permit independent actuation of the snow throwing fans 14, 16. In this manner, either or both of the snow throwing structures 14, 16 can be actuated or deactuated at any time. Through use of hydrostatic motors 18, 20, the hydrostatic pump can be located in the engine compartment or elsewhere on the vehicle and can be interconnected to the hydrostatic motors through flexible hydraulic lines. This eliminates the need for complex, expensive and trouble-prone direct mechanical linkages between a power source and the snow throwing blades 14, 16.

As illustrated, the plow blade 12 is pivotally connected to a mounting bracket 22 located at the forward end of the vehicle 10. Directional control over the plow blade 12 is achieved by means of a hydraulic cylinder 24 coupled to the plow blade 12 through a bell-crank mechanism 26. In the illustrated embodiment, retraction of the hydraulic cylinder 24 positions the blade 12 to direct snow to the left-hand side of the vehicle 10 while extension of the hydraulic cylinder 24 positions the blade 12 to direct snow toward the right-hand side of the vehicle 10.

Figure 3:
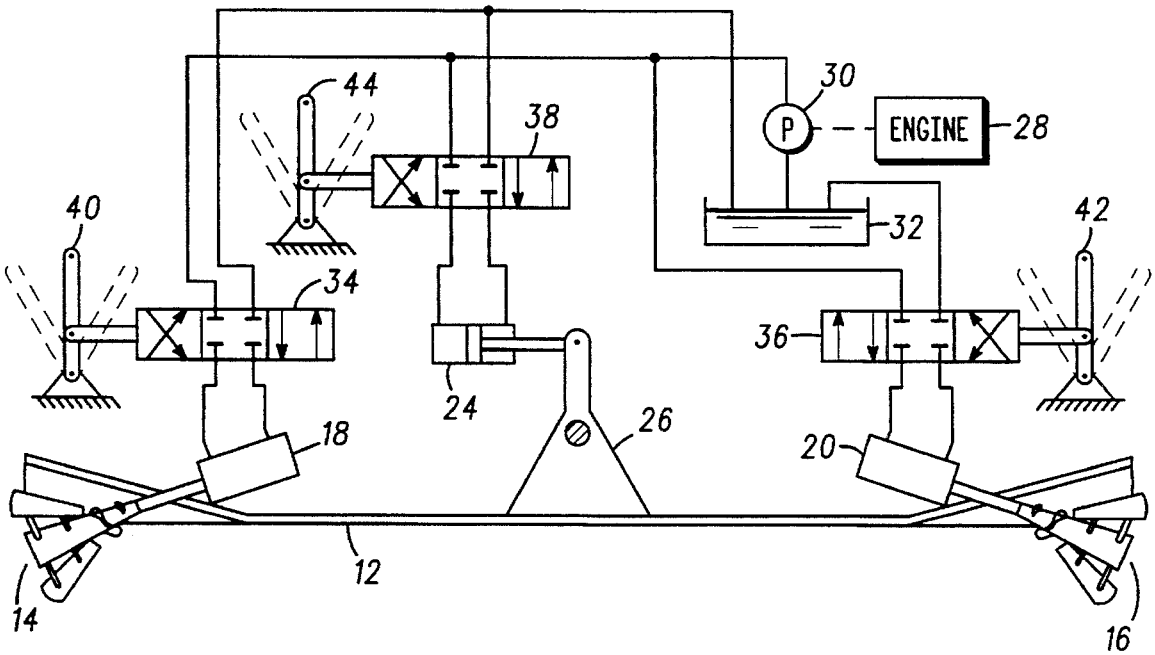
FIG. 3 is a simplified hydraulic schematic diagram of a control system for controlling operation of the reversing snow plow.
Figure 2:
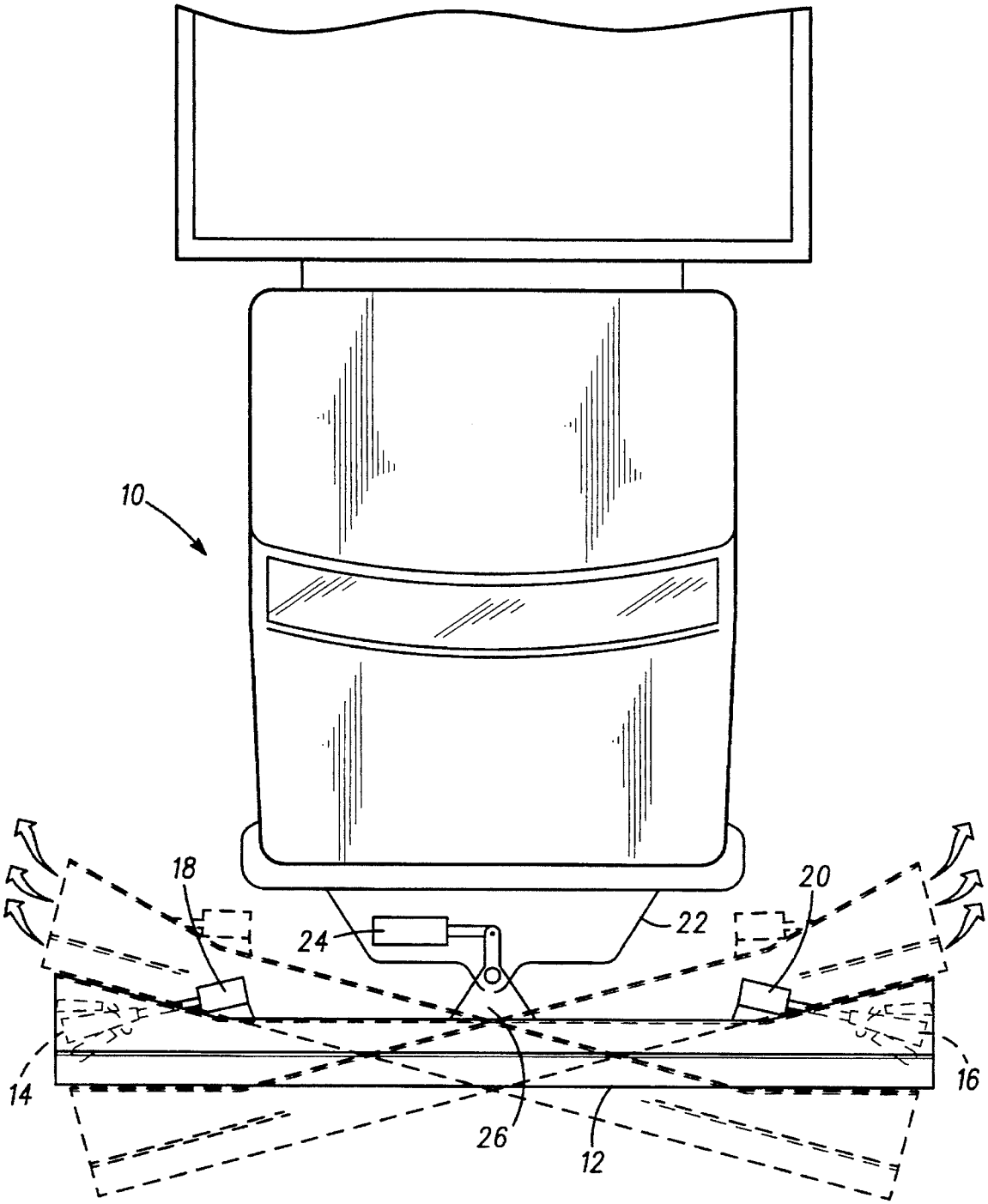
FIG. 2 is a top plan view of the snow removal vehicle shown in FIG. 1 useful in understanding the construction and operation of the reversing snow plow.

A simplified hydraulic circuit for controlling operation of the reversing snow plow is shown in FIG. 3. An engine 28 coupled to a hydraulic pump 30 draws hydraulic fluid from a reservoir or tank 32 and pumps the fluid out under pressure in known manner. Pressurized hydraulic fluid from the pump 30 can be independently supplied to any or all of the hydrostatic snow thrower mechanism motors 18, 20 or the hydraulic cylinder 24 controlling the direction of the plow blade 12. Independently controllable direction control valves 34, 36, 38 coupled between the pump 30 and the hydrostatic motors 18, 20 and hydraulic cylinder 24 permit the motors and the cylinder to be controlled completely independently of each other. The individual controls 40, 42, 44 for controlling the operation of these valves 34, 36, 38 are preferably located in the cab of the vehicle 10 where they can be easily actuated by the vehicle operator.

The snow plow vehicle and reversing snow plow described and illustrated herein provide many advantages over prior snow removal systems. The use of an active snow throwing mechanism 14, 16 in combination with a passive plow 12 disperses snow far more effectively than a plow alone. This is important to avoid burying or obstructing adjacent runway or taxiway lights. The use of independently controllable snow throwing mechanisms 14, 16 at opposite ends of the plow 12 in combination with a reversible mounting of the plow to the vehicle 10 enables the vehicle 10 to clear snow toward one side of the runway while the vehicle passes in both directions up and down the runway. This greatly improves plowing efficiency by eliminating the need to "deadhead" back up the runway before the start of each plowing pass. Furthermore, plowing efficiency is improved by avoiding the creation of windrows after each plowing pass. The plowed snow is instead distributed over a larger area than would be the case using a simple plow alone. The ability of the plow to cast snow is therefore maintained by avoiding localized areas of heavy snow accumulation. Finally, the use of a hydraulic drive mechanism substantially eliminates the need for complex direct mechanical linkages resulting in a more reliable, economical and easily maintainable snow clearing device. It will be appreciated that different forms of snow throwing structures, different sizes and shapes of snow plows and different configurations of control systems can be used in place of those shown without departing from the broader aspects of the invention.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A snow removal vehicle comprising:

an automotive frame having a forward end;

an elongate plow blade mounted at said forward end of said frame for selective movement between right-directing and left-directing plowing positions;

a pair of independently actuable powered, rotating snow throwing structures at opposite ends of said plow blade; and control means for selectively actuating either one of said snow throwing structures so that a downstream one of said snow throwing structures can be actuated regardless of whether said plow is in said right-directing or said left-directing position to thereby enable said snow removal vehicle to plow and throw snow to the fight or to the left as desired.

2. A snow removal vehicle as defined in claim 1 wherein said automotive frame comprises a four wheel drive vehicle.

3. A snow removal vehicle as defined in claim 1 wherein said snow throwing structures are hydraulically powered.

4. A snow removal vehicle as defined in claim 3 wherein each of said snow throwing structures comprises a hydraulic motor coupled to a rotatable blade.

5. A snow removal vehicle as defined in claim 1 wherein said elongate plow blade is moved between said right-directing and said left-directing plowing positions by means of a hydraulic cylinder.

6. A reversible combined snow plow and snow thrower comprising:

an elongate plow blade having right and left ends;

a movable mount adjacent the center of said plow blade for mounting said plow blade to a supporting structure for pivoting movement to the right and left relative to the supporting structure;

a first powered, rotating snow throwing structure disposed adjacent said right end of said plow blade;

a second powered, rotating snow throwing structure disposed adjacent said left end of said plow blade; and a control system for actuating either of said first and second snow throwing structures so that said first snow throwing structure is actuated when said plow blade is directed to the right and said second snow throwing structure is actuated when said plow blade is directed to the left.

7. A reversible combined snow plow and snow thrower as defined in claim 6 wherein said first and second snow throwing structures are hydraulically actuated.

8. A reversible combined snow plow and snow thrower as defined in claim 7 wherein said first and second snow throwing structures each comprise a hydraulic motor coupled to a rotatable blade.

9. A reversible combined snow plow and snow thrower as defined in claim 6 wherein said movable mount includes a hydraulic cylinder for moving said plow blade relative to said supporting structure.

* * * * *